US010306921B2

(12) United States Patent
Hermans

(10) Patent No.: US 10,306,921 B2
(45) Date of Patent: Jun. 4, 2019

(54) CONTAINER

(75) Inventor: Lucas Hermans, Malmo (SE)

(73) Assignee: Fiedler & Lundgren AB, Malmo (SE)

( * ) Notice: Subject to any disclaimer, the term of this patent is extended or adjusted under 35 U.S.C. 154(b) by 620 days.

(21) Appl. No.: 13/502,343

(22) PCT Filed: Sep. 30, 2010

(86) PCT No.: PCT/EP2010/064546

§ 371 (c)(1),
(2), (4) Date: Aug. 15, 2012

(87) PCT Pub. No.: WO2011/051077

PCT Pub. Date: May 5, 2011

(65) Prior Publication Data

US 2012/0325698 A1 Dec. 27, 2012

(30) Foreign Application Priority Data

Oct. 30, 2009 (GB) ..... 0918990.3

(51) Int. Cl.

| | |
|---|---|
| ***B65D 85/00*** | (2006.01) |
| ***A24F 23/00*** | (2006.01) |
| ***B65D 43/20*** | (2006.01) |
| ***A24F 23/04*** | (2006.01) |

(52) U.S. Cl.

CPC ..... *A24F 23/00* (2013.01); *A24F 23/04* (2013.01); *B65D 43/20* (2013.01)

(58) Field of Classification Search

CPC ..... A24F 23/04; A24F 23/00; A45C 11/24; B65D 1/22; B65D 43/20; B65D 43/12; B65D 83/04; B65D 47/286

USPC ..... 206/256, 267, 236, 242, 37; 131/329; 220/345.1, 345.4, 345.2, 345.3, 521, 522, 220/523

See application file for complete search history.

(56) References Cited

U.S. PATENT DOCUMENTS

| | | | | | |
|---|---|---|---|---|---|
| 1,341,295 | A | * | 5/1920 | Burtis | 206/92 |
| 1,610,647 | A | | 12/1926 | Anderson | |
| 1,935,840 | A | * | 11/1933 | Fitzgerald | 206/267 |
| 2,008,001 | A | * | 7/1935 | Burnham | 206/536 |
| 2,058,608 | A | | 10/1936 | Maeda | |
| 2,162,222 | A | * | 6/1939 | Lachter | 206/5 |
| 2,219,179 | A | * | 10/1940 | Fayer et al. | 206/249 |
| 2,237,388 | A | * | 4/1941 | Hutchens | 232/41 R |
| 2,378,003 | A | * | 6/1945 | Duell | 221/93 |
| 2,531,737 | A | * | 11/1950 | Lyon, Jr. | 220/345.3 |

(Continued)

FOREIGN PATENT DOCUMENTS

| | | |
|---|---|---|
| EP | 0350739 A1 | 1/1990 |
| EP | 0911274 A1 | 4/1999 |

(Continued)

OTHER PUBLICATIONS

International Search Report and Written Opinion, dated Mar. 15, 2011, for PCT/EP2010/064546, filed Sep. 30, 2010.

(Continued)

*Primary Examiner* — Andrew D Perreault

(74) *Attorney, Agent, or Firm* — McKee, Voorhees & Sease, PLC

(57) ABSTRACT

A container for snus comprising a cover slidable between an open and a closed position to allow access to a compartment for storing snus within the container when the cover is in its open position.

18 Claims, 12 Drawing Sheets

(56) References Cited

U.S. PATENT DOCUMENTS

| | | | | |
|---|---|---|---|---|
| 2,868,360 | A * | 1/1959 | Donkin | 206/3 |
| 3,352,446 | A * | 11/1967 | Anderson et al. | 220/345.4 |
| 3,362,564 | A * | 1/1968 | Mueller | 220/345.3 |
| 3,960,270 | A * | 6/1976 | May | 206/256 |
| 4,612,943 | A | 9/1986 | Meinkowsky | |
| 5,044,500 | A * | 9/1991 | Webber et al. | 206/456 |
| 5,107,990 | A | 4/1992 | Wicherski | |
| 5,577,629 | A * | 11/1996 | Rosler | 220/525 |
| 5,709,232 | A * | 1/1998 | Sheffler et al. | 220/504 |
| 5,957,319 | A | 9/1999 | Shane da Costa | |
| 6,507,957 | B1 | 1/2003 | Ingram | |
| 6,540,098 | B1 | 4/2003 | Jarvis et al. | |
| 7,481,339 | B1 | 1/2009 | Hsu | |
| 7,584,843 | B2 * | 9/2009 | Kutsch et al. | 206/267 |
| 2004/0056035 | A1 | 3/2004 | Baker et al. | |
| 2005/0173272 | A1 * | 8/2005 | Lemmons, IV | 206/256 |
| 2007/0278228 | A1 | 12/2007 | Wong | |
| 2008/0073343 | A1 | 3/2008 | Shadrach et al. | |
| 2012/0168329 | A1 * | 7/2012 | Berggren | 206/256 |

FOREIGN PATENT DOCUMENTS

| | | | |
|---|---|---|---|
| EP | 0913336 | A1 | 5/1999 |
| FR | 2637573 | A1 | 4/1990 |
| GB | 2243149 | A | 10/1991 |
| GB | 2419338 | A | 4/2006 |
| WO | 2005/016036 | A1 | 2/2005 |
| WO | 2007/010417 | A2 | 1/2007 |

OTHER PUBLICATIONS

Written Opinion, dated Oct. 20, 2011, for PCT/EP2010/064546, filed Sep. 30, 2010.

International Preliminary Report on Patentability, dated Dec. 23, 2012, for PCT/EP2010/064546, filed Sep. 30, 2010.

* cited by examiner

CONTAINER

CLAIM FOR PRIORITY

This application is a National Stage Entry entitled to and hereby claims priority under 35 U.S.C. §§ 365 and 371 to corresponding PCT Application No. PCT/EP2010/064546, filed Sep. 30, 2010, which in turn claims priority to British Application Serial No. GB 0918990.3, filed Oct. 30, 2009. The entire contents of the aforementioned applications are herein expressly incorporated by reference.

The present invention relates to a container for storing tobacco products, in particular smokeless tobacco products, such as snus.

Current packaging for tobacco products such as snus and snuff comprises a base for holding the product and a lid resealably attached to the base so as to maintain the freshness of the product. Generally, tobacco products, including snus, are discarded after use. However, littering of tobacco products is a common problem as its consumption is not always restricted to a designated area and so a user may not always be in the vicinity of a bin when they need to dispose of the consumed tobacco product.

To overcome the above mentioned problem, it is known from WO 2005/016036 A1 to provide a container comprising a primary compartment for holding fresh snus and a secondary disposal compartment for temporarily receiving consumed snus. The secondary compartment is closable by a cover which is hingedly attached to said secondary compartment. However, a disadvantage of this type of container is that it is prone to accidental opening as it relies on a portion of the cover being snapped into a cavity so as to secure the cover in a closed position and retain the used snus in the secondary compartment.

A container having a secondary compartment wherein the cover is detachable such that the cover and lid are not connected via a hinge is also known. However, the cover of such a container is clipped onto the lid, and so the clipping function is reduced with the repeated removal and attachment of the cover due to wear. Furthermore, with the above configuration the cover may completely detach from the lid causing the discarded snus to fall out.

The present invention seeks to provide a container for snus that overcomes or substantially alleviates the problems mentioned above.

According to the present invention, there is provided a container for snus comprising a cover slidable between an open and a closed position to allow access to a compartment for storing snus within the container when the cover is in its open position.

Preferably, the container further comprises a base and a lid defining a first compartment for storing fresh snus, wherein the compartment for storing snus is a second compartment formed in the lid or the base for storing used snus, such that the cover is slidable between open and closed positions to allow access to said second compartment when the cover is in its open position.

Conveniently, the lid or the base has a wall and the cover lies on a plane of the wall and is slidable on said plane between its open and closed positions.

Advantageously, the wall is an upper wall with a peripheral wall depending therefrom, and the second compartment extends from said upper wall.

The cover may have a protruding portion at one end of the cover which is locatable against an upstanding shoulder which upstands in the second compartment such that, when the cover is urged into its open position, the protruding portion abuts said upstanding shoulder to limit the movement of the cover in its open position Preferably, the cover comprises a top wall which is extendable over the second compartment, and the protruding portion is an end wall extending from the top wall.

Advantageously, the second compartment extends to the peripheral wall to form a cut out therein, and the end wall covers the cut-out when the cover is in a closed position.

In one embodiment, the protruding portion is a first protruding portion and the cover further comprises a second protruding portion spaced from the first protruding portion which is locatable against the upstanding shoulder.

The second protruding portion may be an end wall extending from the top wall.

The shoulder may be recessed below the plane of the face.

In one preferred embodiment, the shoulder upstands from the centre of the second compartment such that, when the cover is slid in a first direction the first protruding portion abuts said upstanding shoulder to limit the movement of the cover in a first open position, and when the cover is slid in a second direction the second protruding portion abuts said upstanding shoulder to limit the movement of the cover in a second open position.

In another preferred embodiment, the shoulder upstands proximal to one end of the second compartment such that, when the cover is slid in a first direction the first protruding portion abuts said upstanding shoulder to limit the movement of the cover in its open position, and when the cover is slid in a second direction the second protruding portion abuts said upstanding shoulder to limit the movement of the cover in its closed position.

Conveniently, the second compartment comprises a bottom wall with parallel side walls upstanding therefrom, each upstanding side wall having a step formed therein.

The container may further comprise a lip extends along each side wall, spaced from the step to form a track, wherein a portion of the cover is slidably disposed between each lip and step.

Conveniently, the second compartment is formed in the lid.

Preferably, the lid and the base are formed with a second compartment, each with a cover slidable between open and closed positions.

Conveniently, the compartment contains smokeless product.

According to another aspect of the invention, there is provided a lid for a container for snus comprising a compartment for storing used snus and a cover slidable between open and closed positions to allow access to a compartment for storing snus within the container in the open position According to another aspect of the invention, there is provided a snus container comprising a cover slidable between an open and a closed position to allow access to a compartment for storing snus within the container when the cover is in its open position.

Embodiments of the present invention will now be described by way of example only, with reference to the accompany drawings, in which.

Figure 1:
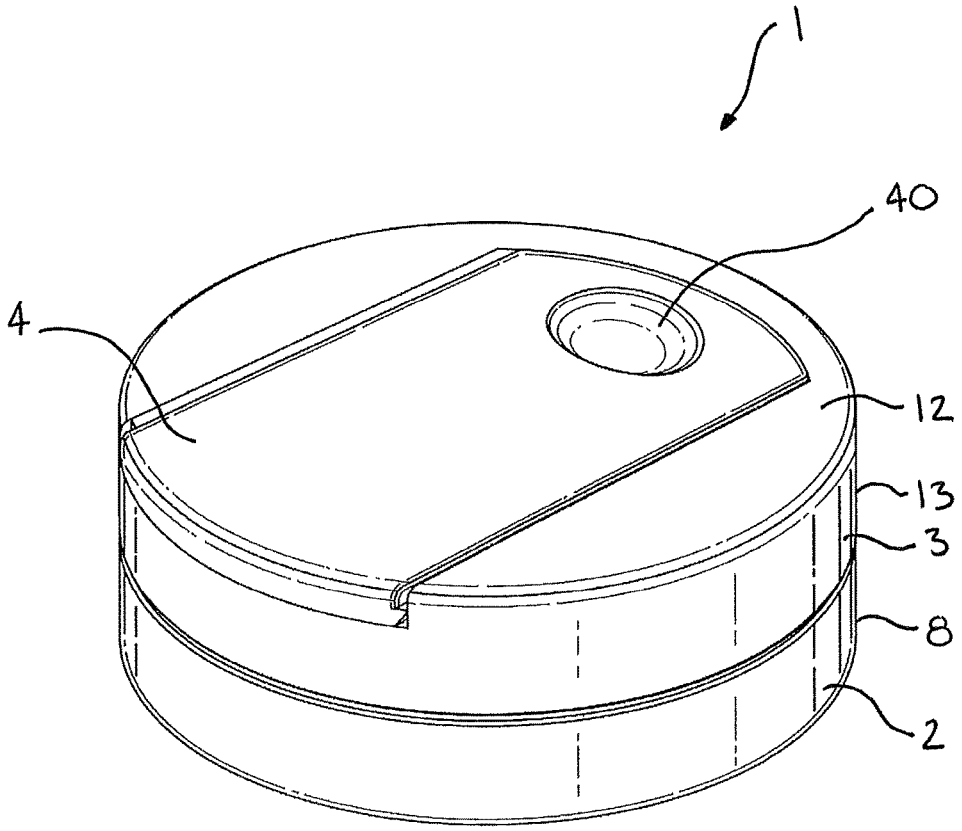
FIG. 1 is a perspective view of a container for snus with a lid and a cover according to an embodiment of the present invention.

Referring now to the drawings, a container 1 is shown in FIGS. 1 to 6 comprising a base 2, a lid 3 and a slidable cover 4. The base 2 and the lid 3 define a first compartment 5 for storing fresh or unused snus, and a second compartment 6 for holding used snus 'U' is defined in the lid 3. The cover 4 encloses the second compartment 6 when slid into a closed position, as will become apparent hereinafter.

The base 2 comprises a circular bottom wall 7 having a side wall 8 which upstands from a periphery thereof. An upper portion 9 of the side wall 8 is recessed and has a smaller outer diameter than a lower portion 10 of the side wall 8, and is provided with a circumferential bead 11 extending therearound.

The lid 3 comprises a circular upper wall 12 from which a peripheral wall 13 depends. The peripheral wall 13 of the lid 3 has an inner diameter which corresponds to the outer diameter of the upper portion of the base side wall 8 so that when the first compartment 5 is enclosed by the base 2 and lid 3 being brought together, the peripheral wall 13 extends over and overlaps the top portion 9 of the base side wall 8. An annular groove 14 is formed on an inner surface of the peripheral wall 13 of the lid 3 which receives the bead 11 of the base 2 when the container 1 is closed so as to retain the lid 3 and base 2 together and so prevent the container 1 from accidentally opening.

The lid 3 has the second compartment 6 which is formed in the upper wall 12 and is closable by the cover 4. The second compartment 6 includes a generally rectangular recess comprising a bottom wall 15, with two parallel long side walls 17*a*, 17*b*, a first short side wall 18 and a second short side wall 19 extending therefrom. The two parallel long side walls 17*a*, 17*b* and the first short side wall 18 extend from the bottom wall 15 to the upper wall 12. The first short side wall 18 extends from the bottom wall 15 to a recessed edge 20 which is recessed below the plane of the upper wall 12, as will be explained below. The first and second short side walls 18,19 extend between the two parallel long side walls 17*a*, 17*b*. Although the long side walls 17*a*,17*b* and short side walls 18,19 are described as such, it will be understood that the length of the respective side walls are not limited as such, and that in an alternative arrangement the long side walls may be shorter in length and extend a shorter distance along the upper wall than the short side walls. The short side walls 18, 19 are arcuate, with the second short side wall 19 lying proximate to a section of the peripheral edge 12*a* of the upper wall 12 and extending parallel thereto, and the first side wall 18 extending parallel to the second short side wall 19. It will be understood that the first and second side walls 18,19 may not be arcuate and may have different shapes, such as planar, and may have different shapes to each other.

Figure 3:
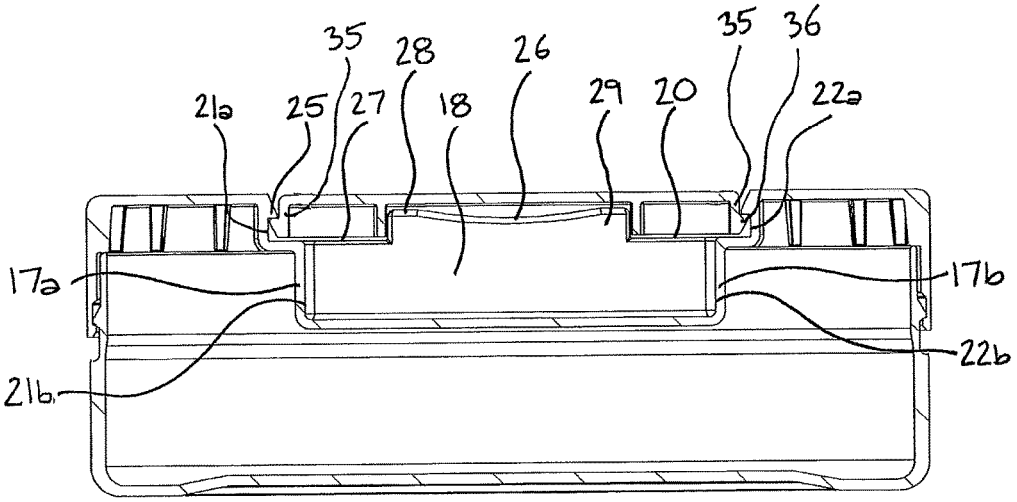
FIG. 3 is a cross-sectional front view of the container shown in FIG. 1.
Figure 4:
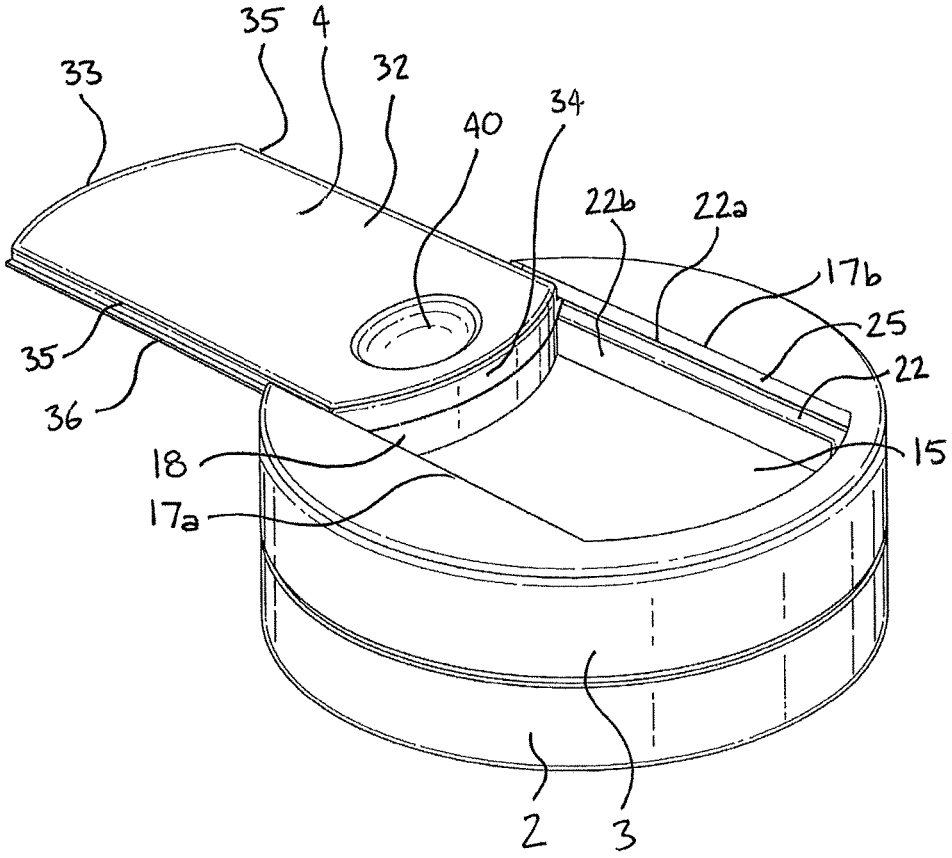
FIG. 4 is a perspective view of the container shown in FIG. 1 with the cover in an open position.
Figure 5:
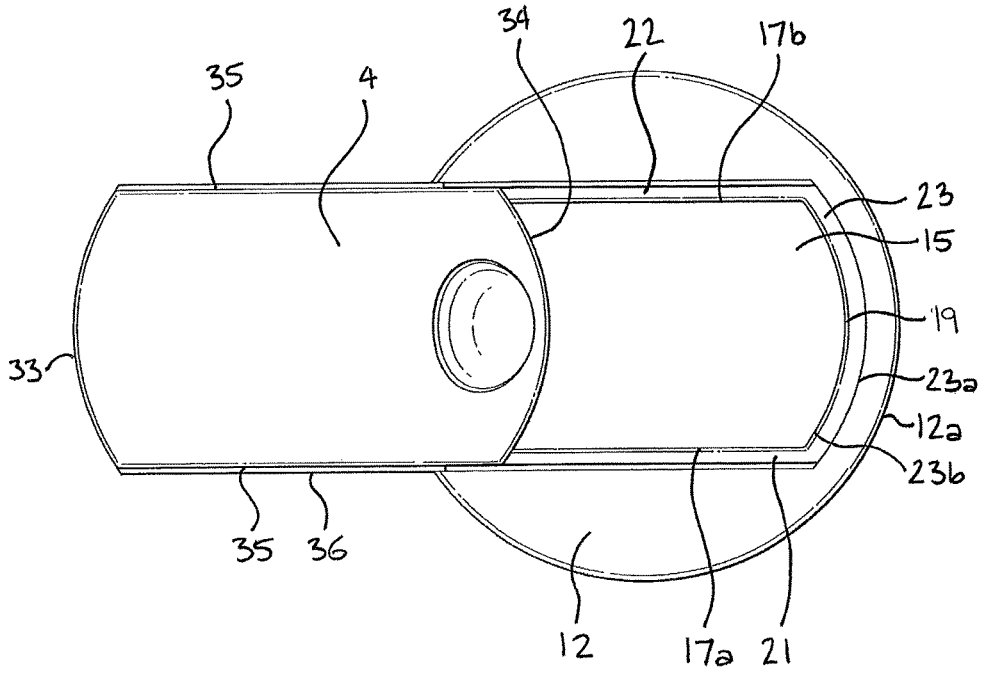
FIG. 5 is a plan view of the container shown in FIG. 1 with the cover in an open position.
Figure 6:
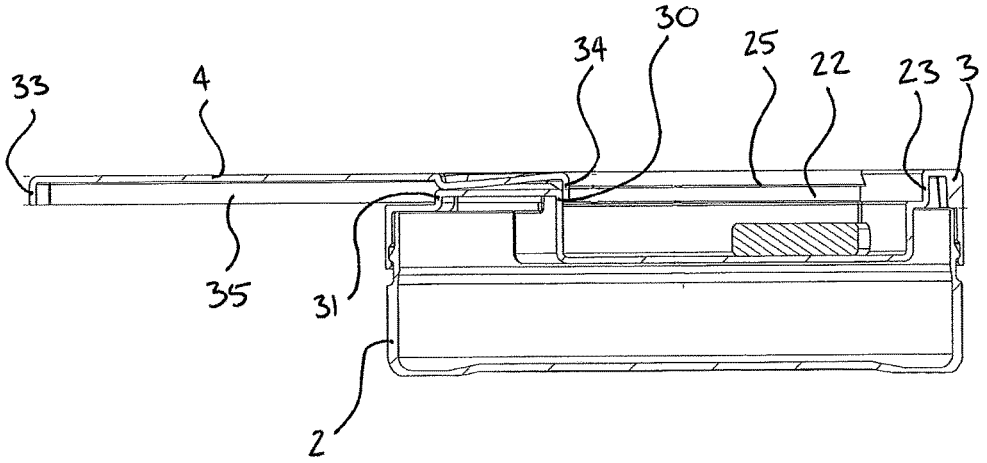
FIG. 6 is a cross-sectional side view of the container shown in FIG. 1 with the cover in an open position.
Figure 7:
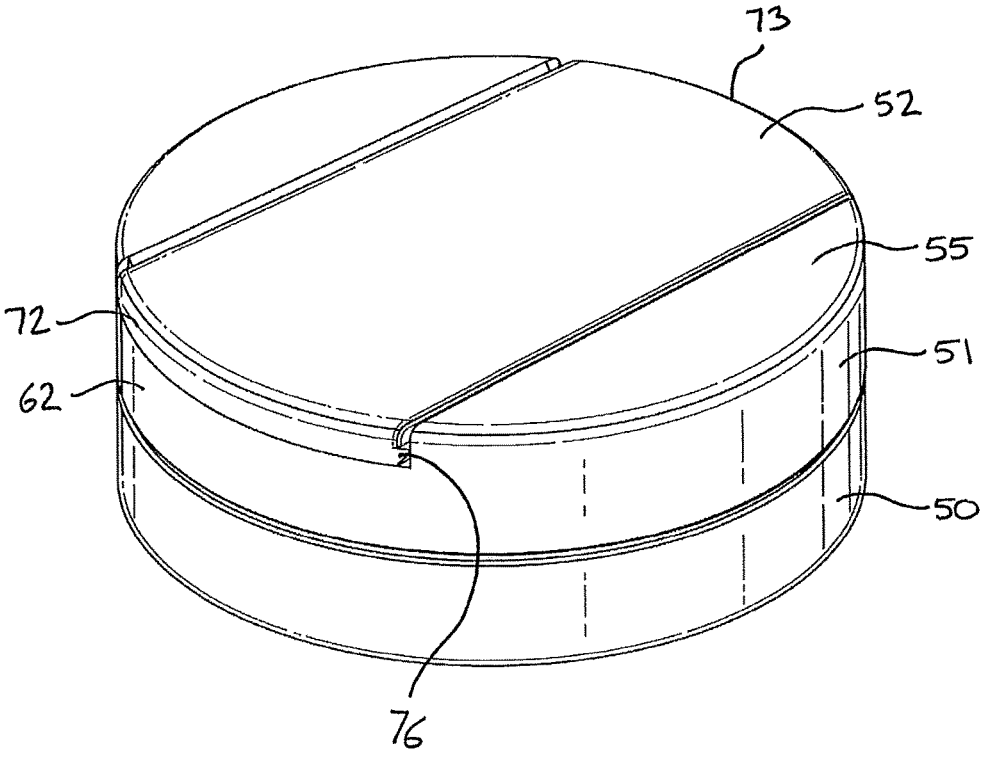
FIG. 7 is a perspective view of a container for snus with a lid and a cover according to an alternative embodiment of the invention.
Figure 8:
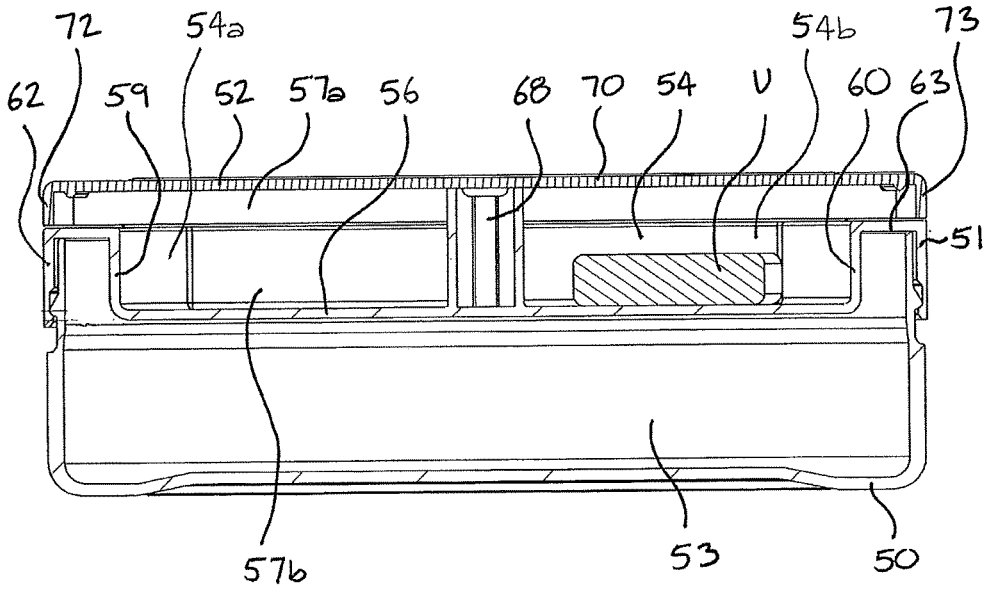
FIG. 8 is a cross-sectional side view of the container shown in FIG. 7 with the cover in a closed position.

The long side walls 17*a*,17*b* and the second short side wall 19 each have a step 21,22,23 formed therein which extends therearound and divides said side walls into upper 21*a*, 22*a*, 23*a* and lower portions 21*b*, 22*b*, 23*b* as can be appreciated from FIGS. 3 to 6. The lower portions 21*b*, 22*b*, 23*b* extend from said edges of the bottom wall 15 to the step 21,22,23 and the upper portions continue from the step 21,22,23 to the upper wall 12 of the lid 3. Although it is not apparent from the drawings, the step 21,22 and the upper portions 21*a*, 22*a* of the long side walls 17*a*, 17*b* further extend beyond the first short side wall 18 to the peripheral wall 13 of the lid 3. Therefore, the second compartment 6 extends to the peripheral wall 13 of the lid 3. Formed along the upper portions 21*a*, 22*a* of the long side walls 17*a*,17*b* is a lip 25 which extends from said upper portions 21*a*,21*b* adjacent and facing step 21,22 such that a track is formed between the lip 25 and the step 21,22 as is shown in FIG. 3. Each track runs along the long side walls 21, 22 of the second compartment 6, from the second short side wall 19 to the peripheral wall 13 of the lid 3 beyond the first side wall 18.

Figure 2:
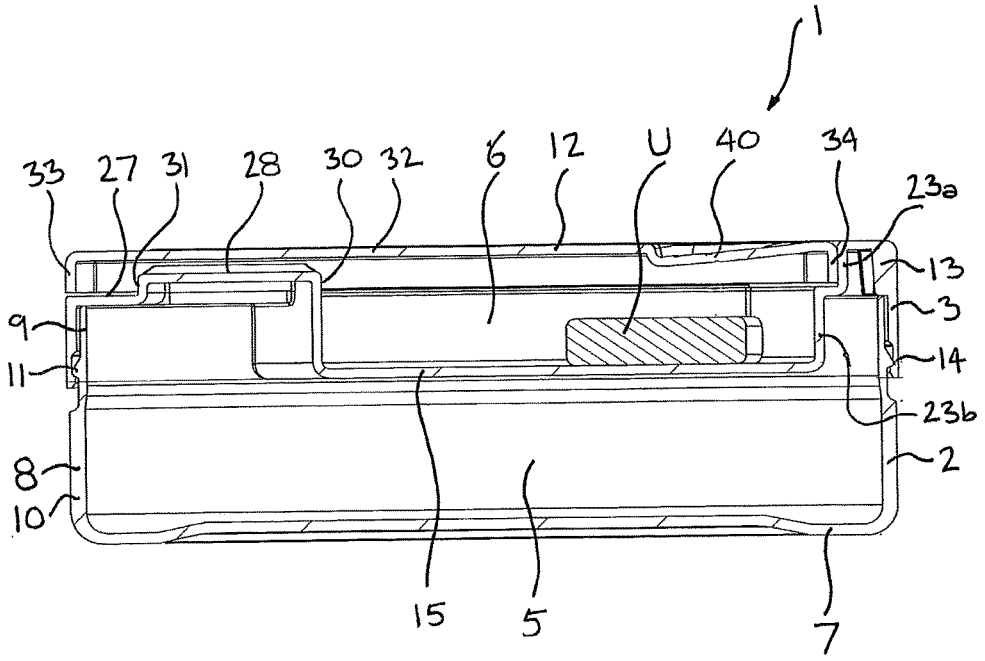
FIG. 2 is a cross-sectional side view of the container shown in FIG. 1 with the cover in a closed position.

The recessed edge 20, which extends along the upper edge of the first short side wall 18 is recessed below the plane of the upper wall 12, and a first upper surface 27 extends therefrom to the peripheral wall 13 of the lid, such that a cut-out is formed in the peripheral wall 13 and defined by the upper portions 21*a*, 22*a* of the long side walls and the first upper surface 27, such that the second compartment extends to the cut-out formed in the peripheral wall. The first upper surface 27 lies on the same plane as the step 21,22,23. A platform 29 upstands from the first upper surface 27, with a second upper surface 28 to define a shoulder against which the cover locates, as will be explained hereinafter, which extends between inner and outer shoulder portions 30,31. The inner shoulder 30 extends from the recessed edge 20 of the first short side wall 18, and the outer shoulder 31 extends from the first upper surface 27, proximate to, but stepped in from, the peripheral wall 13 of the lid 3. The platform 29 is spaced from the upper portions 21*a*,22*a* of the long side walls 17*a*,17*b*. The second upper surface 28 is recessed below the plane of the upper wall 12 of the lid 3, as seen in FIGS. 2 and 3 and includes an arcuate channel 26 which extends between the inner and outer shoulders 30,31 to allow an indentation 40 formed in the cover 4 to slide over the platform 29 without contacting the platform 29, as will be explained below.

The cover 4 is of a generally rectangular shape having a top wall 32 with opposing first and second cover end walls 33,34 and two opposing cover side walls 35 depending from the periphery of the top wall 32. The two opposing cover side walls 35 extend parallel to each other and the cover end walls 33,34 extend between the ends of said opposing cover side walls 35. The depth of each of the cover side walls 35 and cover end walls 33,34 conforms to the depth of the upper portions 21*a*,22*a*,23*a* of the long side walls 17*a*,17*b* and second short side wall 19 of the second compartment 6, such that the top wall 32 of the cover 4 lies level with the upper wall 12 of the lid 3 when the cover 4 is mounted thereto.

A rib 36 is formed along an outer surface of each cover side wall 35, extending between the cover end walls 33,34, proximate to the free edge of each cover side wall 35. The width of the cover 4 between the ribs 36 on opposing cover side walls 35 conforms to the width of the second compartment 6, between the upper portions 21*a*,22*a* of the long side walls 17*a*,17*b*. When the cover 4 is mounted to the lid 3, each rib 36 locates in the tracks of the lid 3 such that the cover 4 is retained by the lid, and each rib is slidable in its corresponding track so the cover can be slid in a direction parallel to the tracks between a closed and an open position.

The cover end walls 33,34 extend arcuately outwards with a curvature corresponding to the arc of the periphery of the upper wall 13 of the lid 3. The length of the cover 4, between the cover end walls 33,34 corresponds to the distance between the upper portion 23*a* of the second short end wall 23*a* of the second compartment 6 and the periphery of the peripheral wall 13 at the cut-out, such that the first cover end wall 33 continues the arc of the peripheral wall 13 when the cover 4 is mounted to the lid 3 and is in the closed position to form a flush outer finish of the lid 3, as shown in FIG. 1. In the closed position, the second cover end wall 34 abuts the upper portion 23*a* of the second short side wall 23.

To open the second compartment 6, a user urges the cover to slide along the direction of the long side walls 17*a*,17*b* of the second compartment 6. By doing so, the ribs 36 slide in their corresponding track defined between the steps 21,22 of the long side walls 17*a*,17*b* and the lips 25, and the end of the cover 4 proximate the first cover end wall 33 is slidable from the cut out formed in the lid peripheral wall 13 such that the second cover end wall 34 moves away from the second short side wall 23 of the second compartment 6, and an opening to the second compartment 6 is formed to allow access to said second compartment 6. As the user further slides the cover 4 into the open position, the second cover end wall 34 contacts the inner shoulder 30 of the platform 29, because the platform upstands in a recess defined by the walls of the cover. As can be appreciated from FIG. 6, the cover 4 is prevented from sliding off the lid due to the presence of the inner shoulder 30. To close the second compartment 6 of the container 1, the user slides the cover 4 in the opposite direction until the second cover end wall 34 abuts the second short side wall 23 of the second compartment 6, and so the second compartment is enclosed, and the cover is in its closed position.

An alternative embodiment of the present invention will now be described with reference to FIGS. 7 to 12. In this alternative embodiment, the container comprises a base 50, a lid 51 and a slidable cover 52. The base 50 and the lid 51 define a first compartment 53 for storing fresh or unused snus, and a second compartment 54 for holding used snus 'U' is defined in the lid 51. The cover 52 encloses the second compartment 54 when slid into a closed position, as will become apparent hereinafter. The base 50 and its configuration with the lid 51 is generally the same as the embodiment described above with reference to FIGS. 1 to 6, and so a detailed description will therefore be omitted herein.

In this alternative embodiment, the cover 52 and the lid 51 are configured such that the cover 52 is slidable in two opposing directions from its closed position, wherein the second compartment 54 is enclosed, to open positions, wherein access is provided to the second compartment 54. The lid 51 comprises a circular upper wall 55 with the second compartment 54 formed therein. In this embodiment the second compartment 54 has a bottom wall 56 with opposing parallel side walls 57,58 upstanding from the bottom wall 56 and opposing second compartment end walls 59,60 extending between the opposing parallel side walls 57,58 and upstanding from said bottom wall 56.

The parallel side walls 57,58 extend across the lid between opposing peripheral edges thereof and have a step 61 dividing each wall into an upper portion 57*a*,58*a*, which extends from the bottom wall 56 to the step 61, and a lower portion 57*b*,58*b*, which extends from the step 61 to the upper wall 55 of the lid 51. Each second compartment end wall 59,60 is arcuate and an upper surface 63 extends from an upper edge of each second compartment end wall 59,60, and each upper surface 63 lies on a plane with the step 61 of each parallel side wall 57,58. Each upper surface 63 extends to the outer surface of a lid peripheral wall 62 and an upper portion 57*a*,58*a* of each side wall 57,58 extends to said outer surface of the lid peripheral wall 62, on opposing sides of the lid 51, such that opposing cut-outs 64 are formed in the peripheral wall 62 from which the cover 52 slides.

A central wall 66 upstands from the bottom wall 55 of the second compartment 54 and extends between the two parallel side walls, midway along, to divide the second compartment 54 into two sub-compartments 54*a*,54*b*. A top surface 67 of the central wall 66 lies on a plane with the step 61 of each parallel side wall 57,58. Although the central wall 66 is shown dividing the second compartment 54 into two equal sized sub-compartments 54*a*,54*b*, it will be understood that the second compartment 54 may be divided to form uneven sized sub-compartments.

A platform 68 upstands from the top surface 67 of the central wall 64 to form a shoulder against which the cover 52 abuts when the cover 52 is slid into one of its two open positions, as will become apparent hereinafter. The shoulder extends above the plane of the step 61, and the upper surface 63 of each arcuate second compartment end wall 59,60, but below the plane of the upper wall 55 of the lid 51, as can be appreciated from FIGS. 8 and 9.

Figure 9:
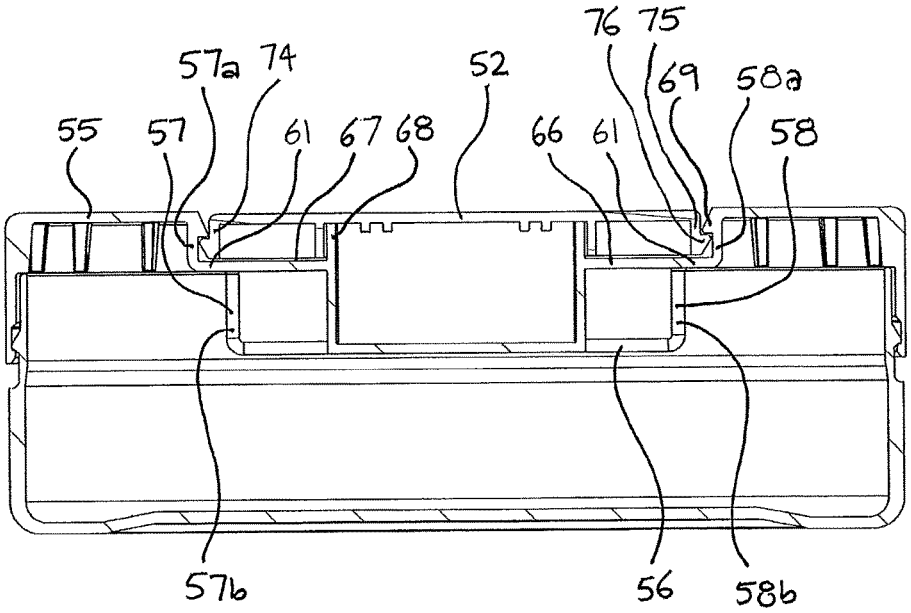
FIG. 9 is a cross-sectional front view of the container shown in FIG. 7.
Figure 10:
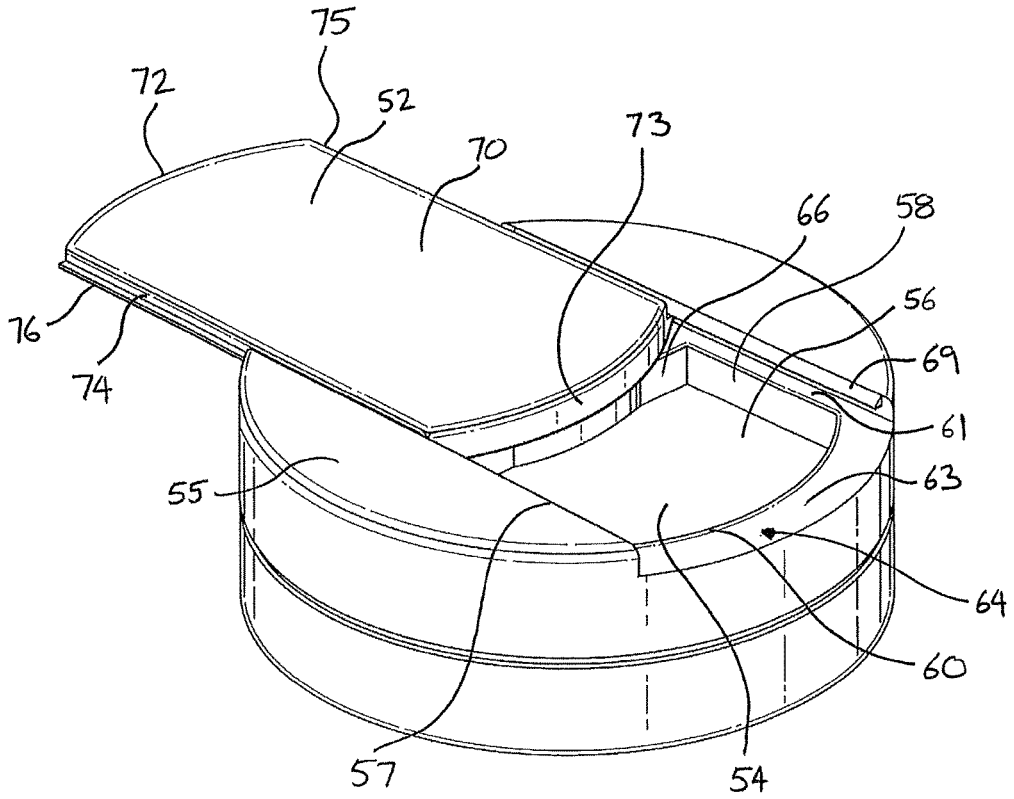
FIG. 10 is a perspective view of the container shown in FIG. 7 with the covet in an open position.
Figure 11:
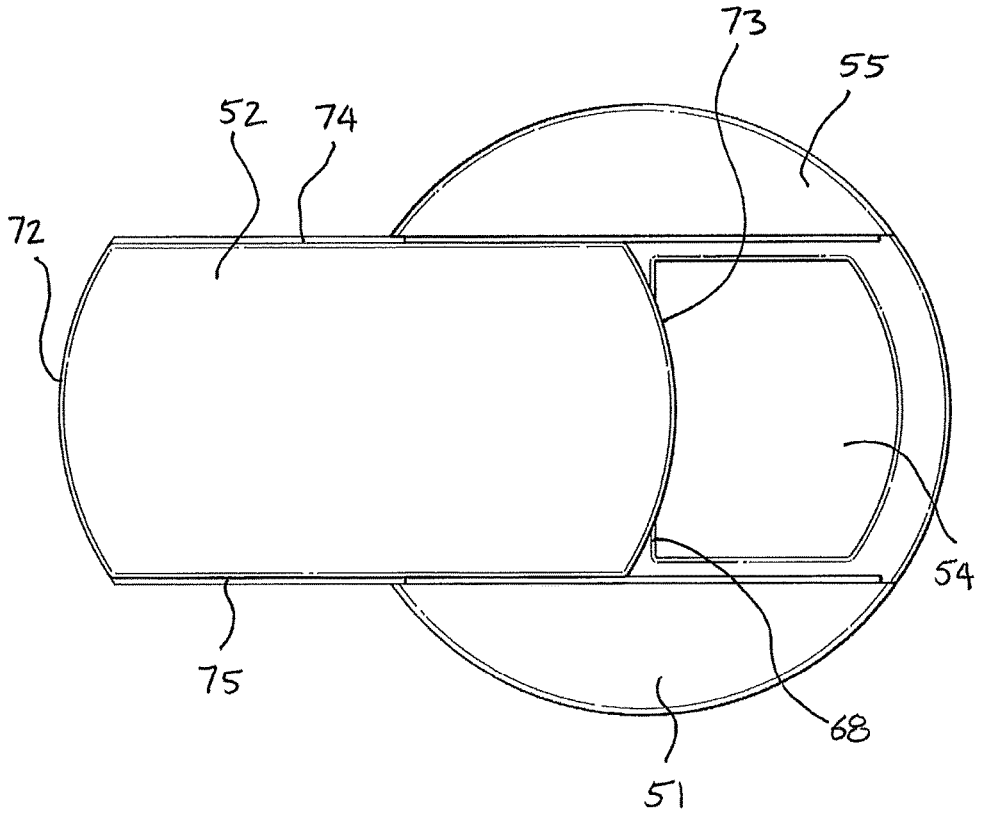
FIG. 11 is a plan view of the container shown in FIG. 7 with the cover in an open position.
Figure 12:
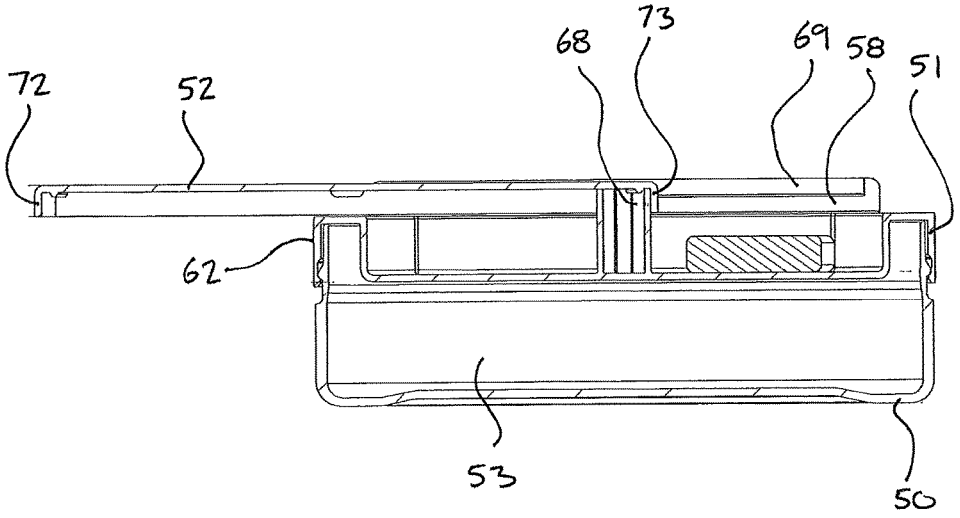
FIG. 12 is a cross-sectional view of the container shown in FIG. 7 with the cover in an open position.

A lip 69 is formed along each of the two opposing parallel side walls 57,58 and extends proximate to the outer surface of the lid peripheral wall 62 at each end, such that a track is formed between said lip 66 and the step 61 on either side of the second compartment 54, as seen in FIGS. 9 and 10.

The cover 52 closing the second compartment 54 is of a generally rectangular shape and comprises a top wall 70 with opposing first and second cover end walls 72,73 and two opposing cover side walls 74,75, each depending from the periphery of the top wall 70 to form a cover peripheral wall. The two opposing cover side walls 74,75 extend parallel to each other and the cover end walls 72,73 extend between the ends of said opposing cover side walls 74,75. The depth of each of the cover side walls 74,75 and cover end walls 72,73 conforms to the depth of the upper portion 57*a*,58*a* of each parallel side wall 57,58 of the second compartment 54, such that the top wall 70 of the cover 52 lies level with the upper wall 55 of the lid 51 when the cover 52 is mounted thereto.

A rib 76 is formed along an outer surface of each cover side wall 74,75, extending between the cover end walls 72,73, proximate to the free edge of each cover side wall 72,73. The width of the cover 52 between the ribs 76 on opposing cover side walls 72,73 conforms to the width of the second compartment 54, between the upper portions 57*a*, 58*a* of each second compartment side wall 57,58. When the cover 52 is mounted to the lid 51, each rib 76 locates in a corresponding track of the lid 51 such that the cover 52 is retained by the lid 51, and each rib 76 is slidable in its corresponding track so the cover 52 can slide in a direction parallel to the tracks between its closed and open positions.

The cover end walls 72,73 extend arcuately outwards with a curvature corresponding to the arc of the lid peripheral wall 62. The length of the cover 52, between the cover end walls 72,73 corresponds to the distance between diametrically opposite sections of the peripheral wall 62 of the lid 51 defined by the opposing cut-outs 64, such that the cover end walls 72,73 continue the arc of the peripheral wall 62 when the cover 4 is in its closed position to form a flush outer finish of the lid 61, as shown in FIG. 1.

To access the sub compartments 53*a*,53*b* of the second compartment 53, a user urges the covet 52 to slide along the axis of the lid parallel side walls 57,58 in one of its two opposing directions, parallel to the longitudinal axis of the cover 52. By doing so, each rib 76 slides in its corresponding track defined between the step 61 and each lip 69, and one end of the cover 52 is slidable from one of the cut outs 64 formed in the lid peripheral wall 62 such that the other end of the cover 52 slides away from the peripheral wall 62, towards the centre of the lid 51, and an opening to the second compartment 53 is formed to allow access to said second compartment 53.

As the user further slides the covet 52 into one of the open positions, one of the cover end walls 72,73 contacts the upstanding shoulder formed by the platform 68, because the shoulder upstands above the plane of the step 61 and extends above the free edge of the respective end wall 72,73. As can be appreciated from FIG. 12, the covet 52 is prevented from sliding off the lid 51 due to the presence of said shoulder. To close the second compartment 53, the user slides the cover 52 in the opposite direction. If the user continues to slide the cover in said opposite direction relative to the lid 51, the other end of the cover 52 slides from the opposing cut out 64 formed in the lid peripheral wall 62, such that the other sub-compartment is exposed. The other cover end wall 72,73 will then contact the upstanding shoulder formed by the platform 68 to restrict movement of the cover 52 relative to the lid 51 and so this configuration also prevents the cover from accidentally detaching from the lid.

It shall be appreciated that the central wall, together with the platform forming the shoulder, may not extend between the two opposing parallel side walls 57,58 to divide the second compartment 53 into two sub compartments 53*a*, 53*b*. It is envisaged that any other configuration which forms a shoulder falls within the scope of the present invention. For example, the central wall may be replaced by a protrusion or rod which extends from the bottom wall of the second compartment 53, but does not divide the second compartment into two sub-compartments.

The above described configuration of the slidable cover and the second compartment is not restricted to the lid. A second compartment according to any of the above described embodiments may alternatively be formed in the base, or in both the base and the lid. For example, a shoulder and a second compartment may be formed in a main wall of a base, the base being further configured to receive a slidable cover in accordance with any of the described embodiments. It shall also be appreciated that the above embodiments are not restricted to one or two second compartments. For example, a slidable cover according to the present invention may close a plurality of second compartments. Furthermore, a plurality of second compartments formed on the main wall of the lid and/or the base may be closable by individual slidable covers.

It shall also be understood that the cover 4, 52 described above may be formed with an indentation so as to improve the grip of the user when they slide the cover between and open and closed positions. For example, as illustrated in FIGS. 1 to 6, the top wall 32 of the cover 4 is formed with an indentation 40 into which the user can place their thumb or finger as they slide the cover 4 between open and closed positions. As described above, an arcuate channel 26 is formed extending between the inner and outer shoulders 30,31 of the platform 29 to allow the indentation to slide therein without contacting said shoulders. A similar indentation may be formed on the cover 52 described with reference to FIGS. 7 to 12. However, it should be realised that the indention is not essential to the invention but may improve the ease of opening and closing the disposal compartments 6, 53.

The configuration of the cover 4, 52 and the lid 3, 51 of the above described embodiments enables a user to access the disposal compartment 6, 53 single handedly as the cover 4, 52 can easily slide between an open and closed position without the possibility of the cover 4, 52 becoming completely detached from the lid 3, 51.

The sliding mechanism of the present invention also provides an improvement over containers having a disposal compartment closable by a cover relying on a clipping function which after repeated use suffers from wear and tear and so is prone to accidental opening as discussed in the introduction.

It will be appreciated that the invention is not limited to cylindrical containers, and that the base, lid and cover may be formed in many different shapes, for example a cuboid shape, and/or with square edges.

Although embodiments of the invention have been shown and described, it will be appreciated by those persons skilled in the art that the foregoing description should be regarded as a description of preferred embodiments only and that other embodiments that fall within the scope of the appended claims are considered to form part of this disclosure.

The invention claimed is:

1. A snus container, comprising:

a base and a lid, said base and lid overlapping to define a first compartment for storing fresh snus, a second compartment formed in one of the lid and the base for storing used snus, the second compartment including a bottom wall, two long side walls and a short side wall, the side walls each having a lower side wall portion extending from an edge of the bottom wall, a step extending outwardly therefrom, and an upper side wall portion parallel to the lower side wall portion; and a cover received in the second compartment and configured to slide between an open position and a closed position and allow access to the second compartment when the cover is in the open position, the cover including opposing cover side walls depending therefrom, each cover side wall dimensioned to substantially conform with a depth of a corresponding upper side wall portion, the container configured such that a top wall of the cover lies planar with or below an upper wall of the lid, the cover being slidable to overlap the side wall steps and abut the upper side wall portions when the cover is in the closed position.

2. The snus container according to claim 1, wherein the cover has a protruding portion at one end of the cover locatable against an upstanding shoulder such that, when the cover is urged into the open position, the protruding portion abuts said upstanding shoulder to limit the movement of the cover in the open position.

3. The snus container according to claim 1, wherein one of the lid and the base has a wall and the cover lies on a plane of the wall and is slidable on said plane between the open and closed positions.

4. The snus container according to claim 3, wherein the wall is an upper wall with a peripheral wall depending therefrom, and the second compartment extends from said upper wall.

5. The snus container according to claim 2, wherein the protruding portion at one end of the cover is locatable against an upstanding shoulder upstanding in the second compartment.

6. The snus container according to claim 5, wherein the cover comprises a top wall extendable over the second compartment, and the protruding portion is an end wall extending from the top wall.

7. The snus container according to claim 6, wherein the second compartment extends to a peripheral wall to form a cut-out therein, and the end wall covers the cut-out when the cover is in the closed position.

8. The snus container according to claim 5, wherein the protruding portion is a first protruding portion and the cover further comprises a second protruding portion spaced from the first protruding portion locatable against the upstanding shoulder.

9. The snus container according to claim 8, wherein the second protruding portion is a second end wall extending from the top wall.

10. The snus container according to claim 8, wherein the shoulder upstands from a center of the second compartment such that, when the cover is slid in a first direction the first protruding portion abuts said upstanding shoulder limiting the movement of the cover in a first open position, and when the cover is slid in a second direction the second protruding portion abuts said upstanding shoulder limiting the movement of the cover in a second open position.

11. The snus container according to claim 8, wherein the shoulder upstands proximal to one end of the second compartment such that, when the cover is slid in a first direction the first protruding portion abuts said upstanding shoulder limiting the movement of the cover in its open position and abuts said upstanding shoulder limiting the movement of the cover in its closed position.

12. The snus container according to claim 1, wherein the second compartment further comprises a lip extending along each side wall and spaced from the step of each said side wall, thereby forming a track, a portion of the cover being slidably disposed in the track.

13. The snus container according to claim 1 wherein the first compartment contains smokeless product.

14. A snus container, comprising:

a base comprising a circular bottom wall and a side wall attached to the circular bottom wall and upstanding from the periphery of the circular bottom wall;

a lid comprising a circular upper wall and a peripheral wall attached to the circular upper wall, said lid having an inner diameter substantially corresponding to an outer diameter of an upper portion of the circular bottom wall;

a first compartment for snus defined in the base; and a second compartment for used snus formed in the lid, the second compartment including a slidable cover received therein, a second compartment bottom wall, and two long side walls each having a lower side wall portion extending from an edge of the second compartment bottom wall, an outwardly extending step, and an upper side wall portion parallel to the lower side wall portion, the slidable cover being slidable to allow access to the second compartment when the cover is open, the slidable cover including two long side walls dimensioned to substantially conform with a depth of a corresponding upper side wall portion, and at least one arcuate short side wall such that the at least one arcuate short side wall lies proximate to a section of the peripheral wall of the lid when the cover is closed;

the container configured such that a top wall of the cover lies planar with or below the circular upper wall of the lid.

15. A snus container, comprising:

a base and a lid, said base and lid overlapping to define a fresh snus storage compartment;

a used snus storage compartment formed in one of the lid and the base, the used snus storage compartment including a first arcuate short side wall and a second arcuate short side wall that is parallel to the first arcuate short side wall; and a cover received in the used snus storage compartment and configured to lie planar with or below an upper wall, the cover being slidable between an open position and a closed position to allow access to the used snus storage compartment when the cover is in the open position.

16. The snus container according to claim 1, the cover further including a rib, the container configured such that the rib is slidably received in a track formed between at least one of the side wall steps and one or more corresponding lips.

17. The snus container according to claim 1, wherein each of the upper side wall portions of the side walls comprises a lip, each said lip and corresponding side wall step defining a track, and configured such that the cover is slidably received in the track.

18. The snus container according to claim 1, wherein the cover further includes a first cover end wall and a second cover end wall, the first cover end wall configured to continue an arc of a peripheral wall of the container so as to form a flush outer finish of a rim of one of the lid and the base when the cover is in the closed position, and the second cover end wall configured to abut the short side wall of the second compartment when the cover is in the closed position.

* * * * *